US005382187A

United States Patent [19]

Wilson

[11] Patent Number: 5,382,187

[45] Date of Patent: Jan. 17, 1995

[54] DOLL HAVING A PHOTOGRAPH FOR A FACE

[76] Inventor: Dorothy A. Wilson, 1710 County House Rd., White Bluff, Tenn. 37187

[21] Appl. No.: 110,317

[22] Filed: Aug. 23, 1993

[51] Int. Cl.[6] ..... A63H 3/36; A63H 3/02

[52] U.S. Cl. ..... 446/391; 446/369; 446/372

[58] Field of Search ..... 446/369, 268, 372, 385, 446/391

[56] References Cited

U.S. PATENT DOCUMENTS

| | | | |
|---|---|---|---|
| 678,244 | 7/1901 | Gross et al. | 446/391 |
| 833,448 | 10/1906 | De Vall et al. | 446/391 |
| 875,954 | 1/1908 | Rouech | 446/372 |
| 1,274,328 | 7/1918 | Price | 446/391 |
| 2,170,971 | 8/1939 | Lodewick et al. | 446/391 |
| 2,199,049 | 4/1940 | Greenberg | 446/391 |
| 2,309,447 | 1/1943 | Greneker | 446/391 |
| 3,026,648 | 3/1962 | Lemelson | 446/391 |
| 4,929,213 | 5/1990 | Morgan | 446/369 |
| 4,993,987 | 2/1991 | Hull et al. | 446/268 |
| 5,009,626 | 4/1991 | Katz | 446/372 |

FOREIGN PATENT DOCUMENTS

| | | | |
|---|---|---|---|
| 22825 | of 1909 | United Kingdom | 446/369 |

*Primary Examiner*—Robert A. Hafer
*Assistant Examiner*—Jeffrey D. Carlson
*Attorney, Agent, or Firm*—I. C. Waddey, Jr.

[57] ABSTRACT

The present invention discloses a specially designed doll that could accept the transfer of a computer portrait directly on its face without wrinkling. The face of the doll is shaped similar to a real face and cut out on the straight of the material to ensure that it does not stretch or wrinkle. The panels forming the sides of the head are cut on the bias of the material in order to stretch with the pressure of the heat press but not affect the face area. This allows the face to remain flat so that the picture does not wrinkle and the result is a clear picture.

11 Claims, 5 Drawing Sheets

DOLL HAVING A PHOTOGRAPH FOR A FACE

BACKGROUND OF THE INVENTION

The present invention relates generally to computer portraits and more particularly to a doll having a computer portrait for a face.

The prior art has produced a rather crude doll with a person's face transferred onto it. In order to accomplish this feat, the face was first heat pressed on to a flat sleeve with a stretch-type back which was then slipped over the head of an already stuffed doll. It was not possible to press the face directly on to the stuffed doll because the surface had to be completely flat to press the picture onto it without wrinkling the surface during the process and thus distorting the image. Therefore, the resulting doll did not look very lifelike.

The technology for computer generated photographs was developed by NASA in the late 1960's to enable the world to get its first close-up glimpse of the moon through use of the technology. This space age technology lead to the development of a process in which a video camera could take a picture, capture it on a television monitor, feed it through a computer which would then send the information to a high speed printer. Such a system has been commercially developed and marketed by Computer Amusement Systems, Inc., 160 S.W. 12th Ave. Suite 106, Deerfield Beach, Fla. 33442. The print-out could then be heat pressed onto various objects such as t-shirts, cups, buttons, aprons, and caps through the use of readily available equipment. Heretofore, however, there has not been available a method or pattern designed that would allow the transfer of the print-out onto a surface other than one that was flat and which was supported so that the pressure of the heat press would not distort the surface and therefore distort the image being transferred. This deficiency in the prior an has limited the ability to use the space-age technology in the creation of three-dimensional products, such as dolls, which bear the likeness of the image on the print-out.

There is no prior art product or method which will create a life-like doll with a face that has an undistorted image of a person. What is needed, then, is a system which allows a portrait to be placed on a doll's face without wrinkling. This needed system must allow the portrait to be placed on the face without undue distortion. This system is presently lacking in the prior art.

SUMMARY OF THE INVENTION

The present invention discloses a specially designed doll (and pattern for making the doll face) that can accept the transfer of a computer generated portrait directly on its face without wrinkling. The face of the doll is shaped similar to a real face and cut out on the straight of the material to ensure that it does not stretch or wrinkle. The two sides of the head are cut on the bias of the material in order to stretch with the pressure of the heat press but not affect the face area. This allows the face to remain flat so that the picture does not wrinkle and the result is a clear picture.

Accordingly, one object of the present invention is to provide a system which allows a computer portrait to be placed on a doll.

Another object of the present invention is to provide a doll which looks lifelike.

A still further object of the present invention is to provide a doll capable of having a computer portrait placed on its face without wrinkling and distortion.

DESCRIPTION OF THE PREFERRED EMBODIMENT

Figure 1:
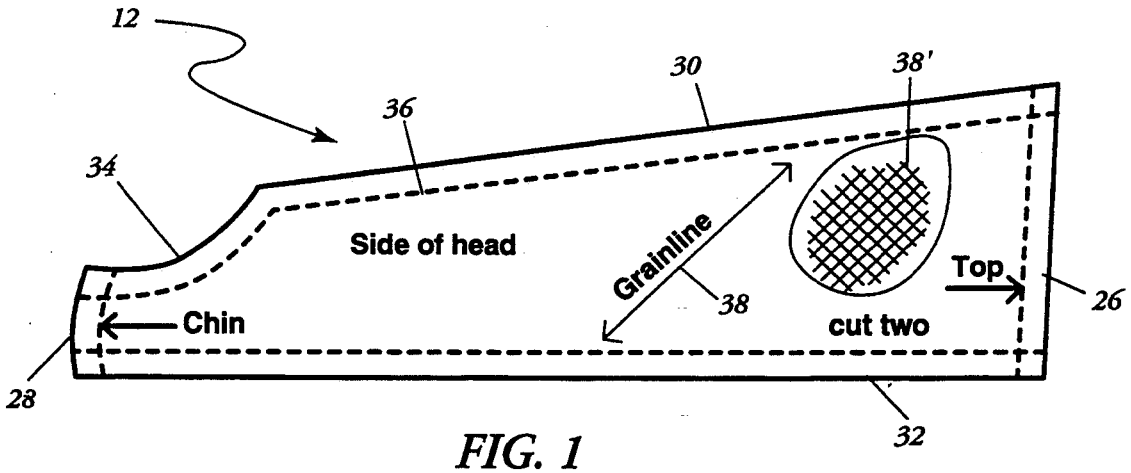
FIG. 1 is a plan view of the pattern for the side of the head.

Referring now to FIG. 1 there is shown generally at 12 the pattern for the side of the head of the doll of the present invention. Head pattern 12 is cut such that head top 26 is wider than chin 28 so that rear edge 30 and front edge 32 approach each other as they go from head top 26 to chin 28. Further, the side of head pattern 12 has cut-out 34. Around the perimeter of the side of head pattern 12 there is placed side of head pattern seam 36 which is approximately one-quarter (¼") of an inch. The side of the head panel is made in the shape of the side of the head pattern 12 and is constructed of a square grid grain fabric. The square grid grain of the fabric for the side of the head panel in the shape of the side of the head pattern 12 is shown at 38' in FIG. 1. A square grid grain fabric is one in which the threads of the fabric run perpendicular to each other and form a grid of many squares as is shown at 38'. The grain line of a square grid grain fabric is a line that runs parallel to one set of the threads of the fabric and perpendicular to the other set of threads the fabric. When the side of the head panel is cut from the square grid grain fabric, it is cut so that the side of head grain line 38 lies at an approximate forty-five degree (45°) angle from rear edge 30 substantially shown in FIG. 1.

Figure 2:
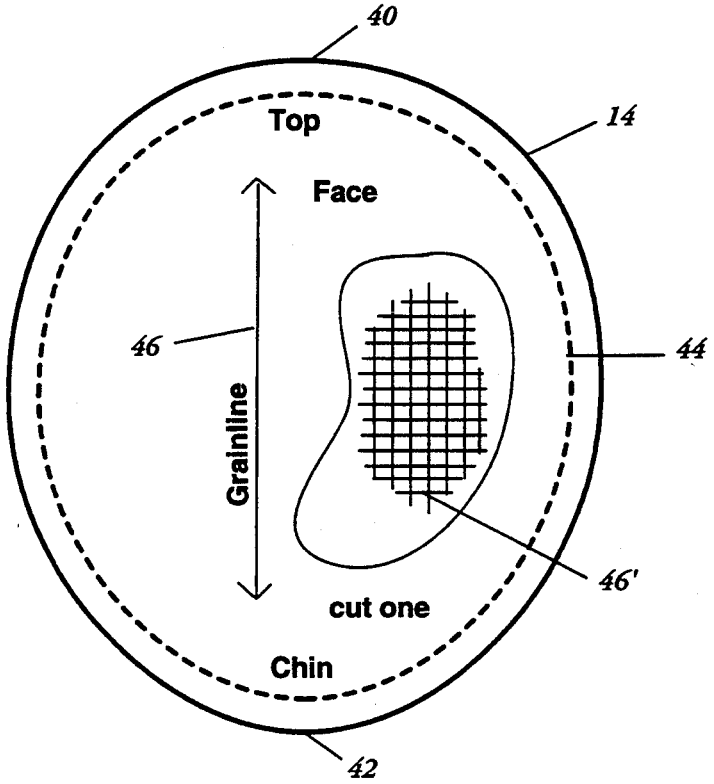
FIG. 2 is a plan view of the pattern for the face.

Referring now to FIG. 2 there is shown generally at 14 the face pattern of the present invention. Face has top 40 and bottom 42 such that bottom 42 resides proximate to chin 28. Front face seam 44 encircles perimeter of face pattern 14 leaving approximately a one-quarter inch (¼") seam. The face of the doll panel which is cut in the shape of the face pattern 14, is cut from a square grid grain fabric. The square grid grain of the fabric of the face panel of the doll is shown in exploded illustration at 46' in FIG. 2. When the face panel is cut in the shape of face pattern 14 from fabric having a square grid grain 46', the face panel is cut from the fabric so that the grain line 46 runs substantially from between bottom 42 and top 40 in a vertical direction as shown in FIG. 2.

Figure 3:
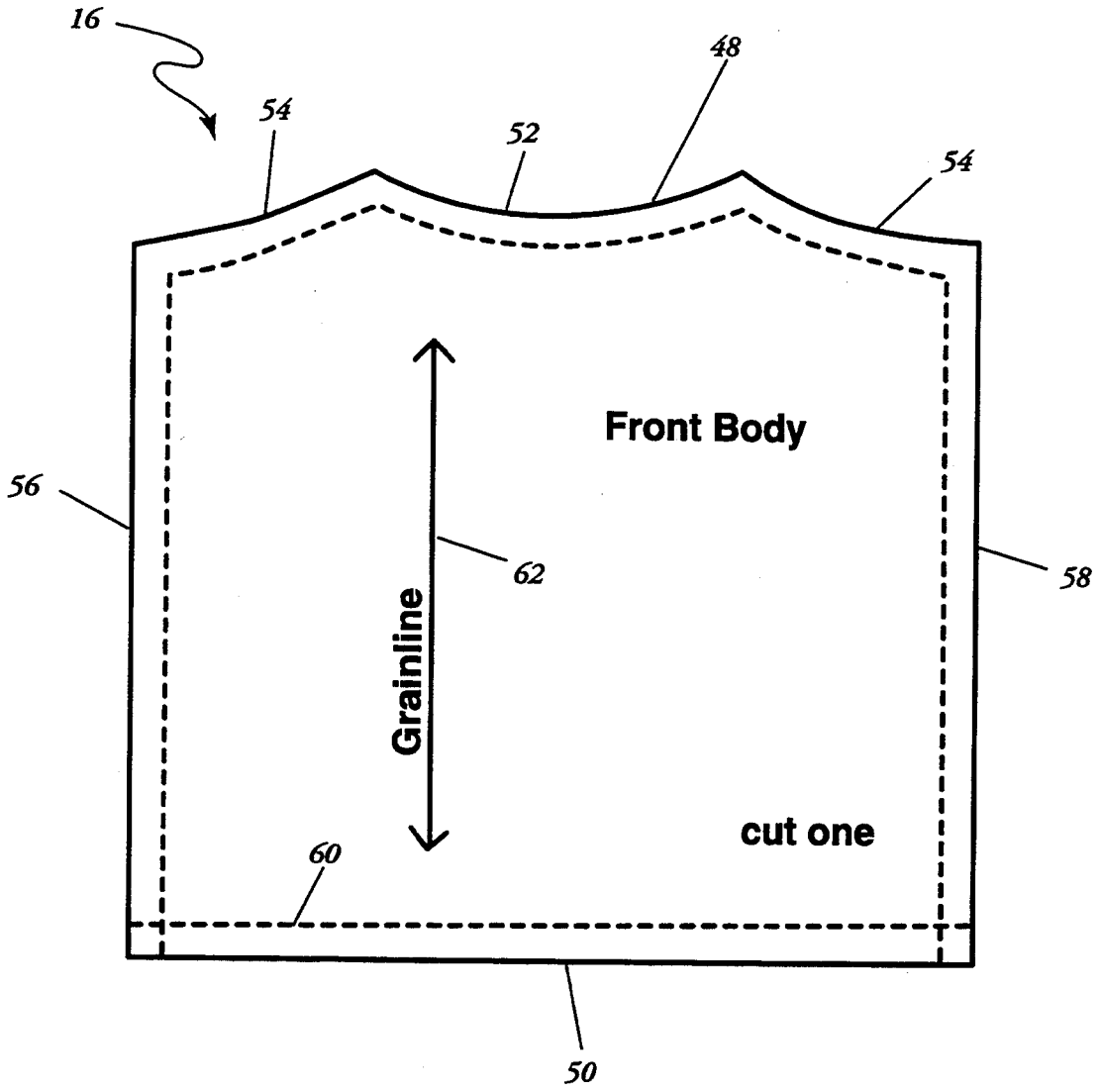
FIG. 3 is a plan view of the pattern for the front body.

Referring now to FIG. 3 there is shown generally at 16 the front body pattern of the present invention. Front body pattern 16 has upper edge 48 and lower edge 50. In the preferred embodiment, lower edge 50 is substantially flat whereas upper edge 48 has collar 52 and shoulders 54. Front body pattern 16 has left edge 56 and right edge 58 which are substantially parallel. Front body seam 60 passes around perimeter of front body pattern 16 leaving a substantially one-quarter inch (¼") seam. In the preferred embodiment, front body pattern grain line 62 lies substantially parallel to edges 56, 58 as shown in FIG. 3.

Figure 4:
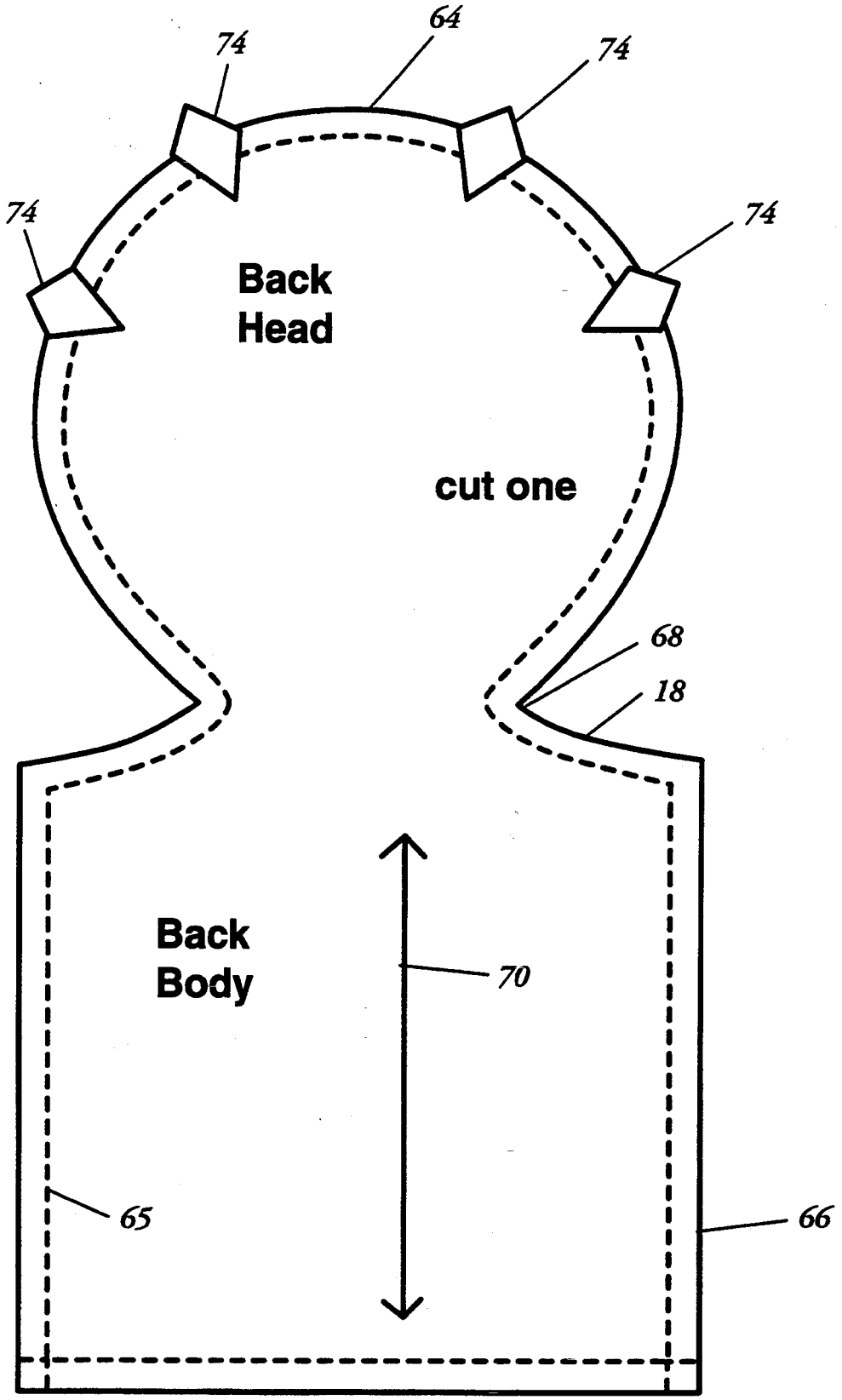
FIG. 4 is a plan view of the pattern for the back body.

Referring now to FIG. 4 there is shown generally at 18 the back of body pattern of the present invention. Back of body pattern 18 has upper silhouette 64 and lower silhouette 66 joined by neck 68. In the preferred embodiment, grain line 70 of back of body pattern 18 runs vertically from upper silhouette 64 to lower silhouette 66 in the manner shown in FIG. 4. Back of body seam 65 runs around silhouette 64,66 leaving a substantially one-quarter inch (¼") seam. Around upper portion of upper silhouette 64 there are placed, in the preferred embodiment, four darts 74.

Figure 5:
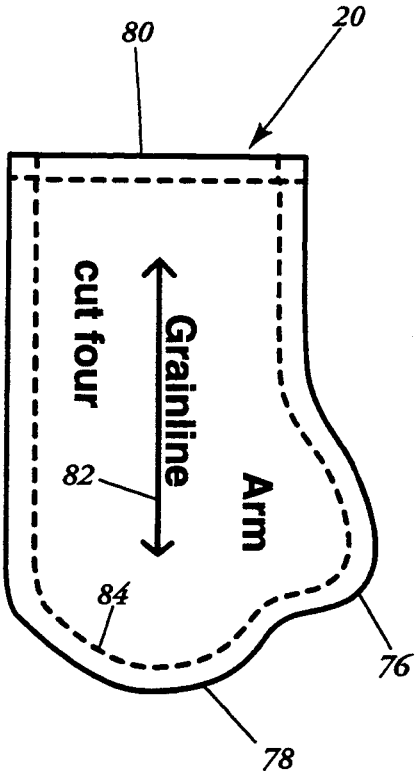
FIG. 5 is a plan view of the pattern for the arm.

Referring now to FIG. 5 there is shown generally at 20 the arm pattern of the present invention. Arm pattern 20 has thumb 76, hand 78, and wrist 80. In the preferred embodiment, arm grain line 82 runs substantially from wrist 80 to hand 78. Arm pattern seam 84 is placed around perimeter leaving approximately a one-quarter inch (¼") seam. In the preferred embodiment, four arm patterns 20 are used.

Figure 6:
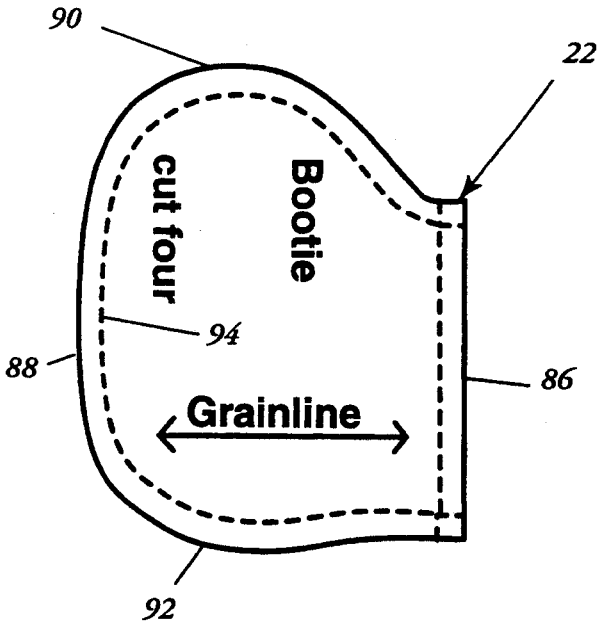
FIG. 6 is a plan view of the pattern for the bootie or foot.

Referring now to FIG. 6 there is shown generally at 22 the foot pattern of the present invention. Foot pattern 22 has ankle 86 and sole 88 along with toe 90 and heel 92. Around perimeter of foot pattern 22 there is placed foot pattern seam 94 which leaves substantially a one-quarter inch (¼") seam. In the preferred embodiment, two foot patterns 22 are used. In the preferred embodiment, foot grain line runs substantially from ankle 86 to sole 88.

Figure 7:
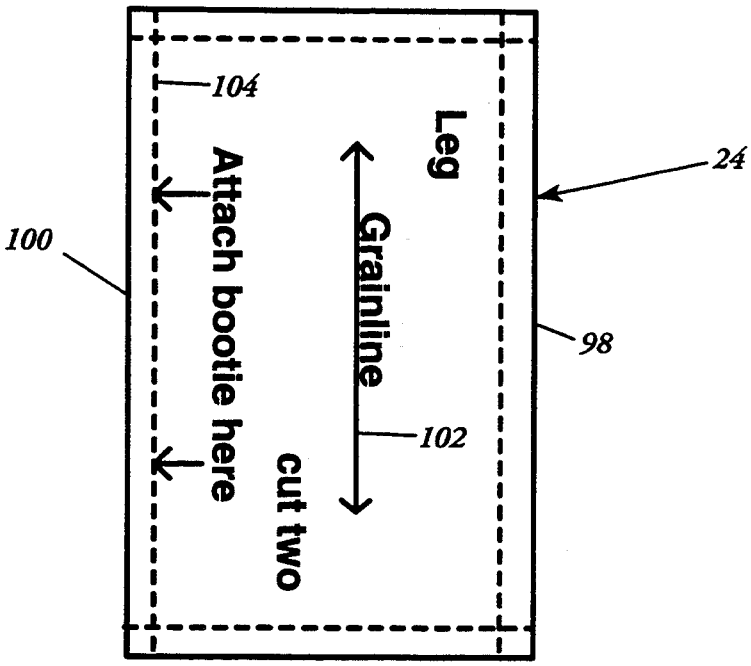
FIG. 7 is a plan view of the pattern for the leg.

Referring now to FIG. 7 there is shown generally at 24 the leg pattern of the present invention. Leg pattern 24 has upper leg 98 and lower leg 100. In the preferred embodiment, grain line 102 of leg pattern 24 runs parallel to upper leg 98 and lower leg 100. Around perimeter of leg pattern 24 there is placed leg pattern seam 104 thereby leaving approximately a one-quarter inch (¼") seam. In the preferred embodiment, two leg patterns 24 are used.

Figure 8:
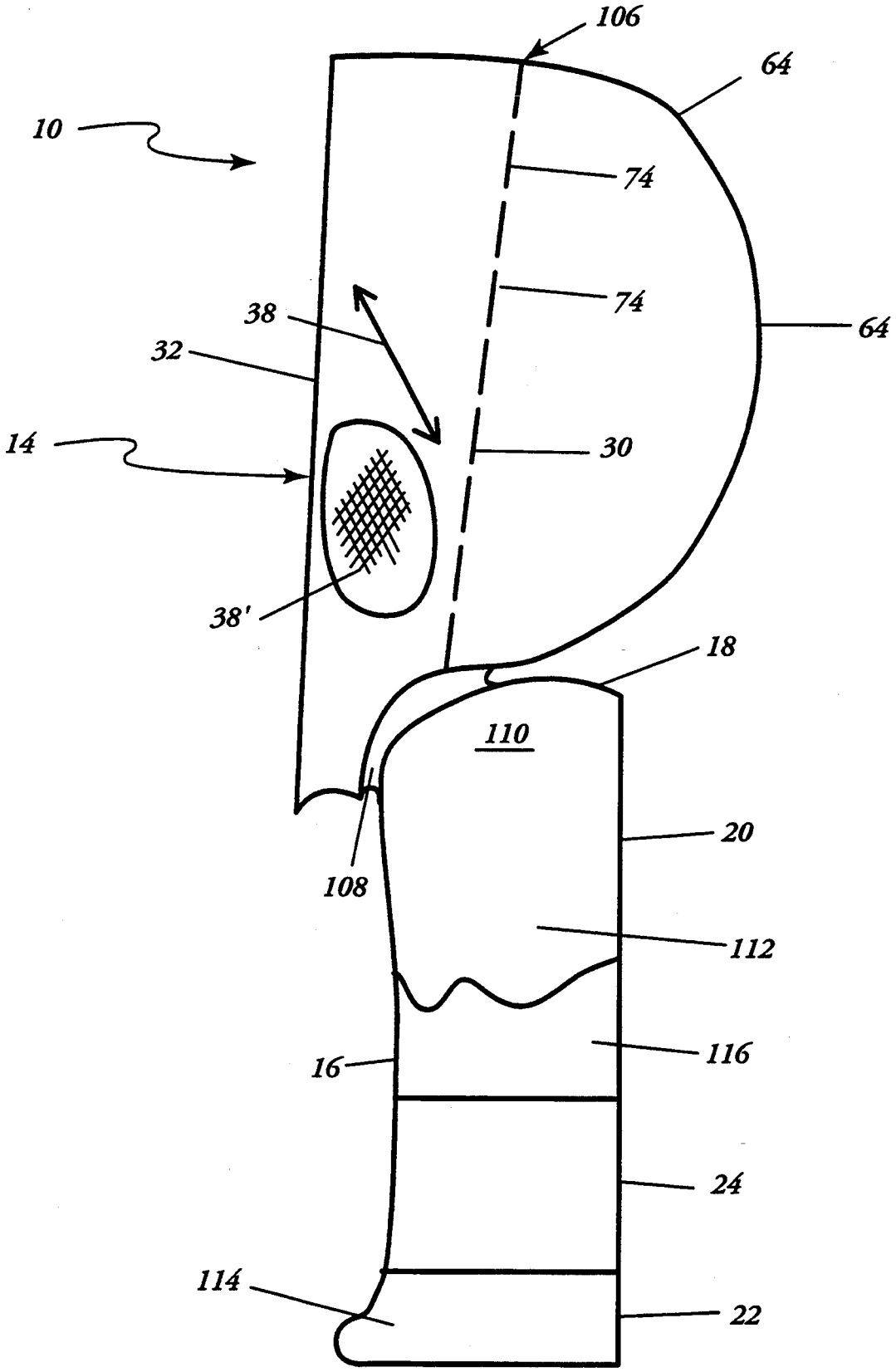
FIG. 8 is a side view of the entire doll.

Referring now to FIG. 8 there is shown generally at 10 the doll of the present invention having a photograph for a face. Doll 10 is constructed by sewing two sides of head patterns 12 together at chin 28 and top 26. Face pattern 14 is then sewed to the connected side of head patterns 12. Face pattern 14 and the two side of head patterns 12 are sewn to front body pattern 16. Darts 74 are taken from upper silhouette 64 and then upper silhouette 64 is sewn to side patterns 12 whereas lower silhouette 66 is sewn to front body pattern 16 thereby creating head 106, neck 108, and shoulders 110. Each pair of arm patterns 20 is sewn thereby creating two arms 112 which are then sewn to the body. Foot patterns 22 are sewn together to create feet 114. Foot patterns 22 are sewn together to a point between heel 92 and sole 88. One each of leg patterns 24 is sewn to feet 114 while leg patterns 24 are also sewed from body pattern 16. Head 106 and body 116 are then stuffed tightly.

The pattern for the head of the doll and the assembly of the pattern is the particularly unique aspect of this invention. Because of the neck 34, the front edge 32 of the side of the head pattern is longer than the rear edge 30. When the side of the head pattern is connected at the top 26 and chin 28, it creates a front (front edge 32) which will be formed into an oval shape having an edge with a perimeter concentric with the seam line of the face 14 of the doll and a rear edge 30 with a seam line concentric with the seam line of the back of the head 64. Darts 74, when sewn together, cause the back of the head to be smaller than the face and, when stuffed with filler material, to have a spherical shape so that the head of the doll will simulate the shape of a person's head.

As shown in FIGS. 1 and 8, the side of the head pattern is cut diagonally of the grain 38. If the cut of the side of the head pattern is square to the grain of the fabric, any pull on the side of the head pattern caused by pressure applied to the face of the doll will tend to cause the face to pucker and wrinkle. However, by cutting the side of the head pattern at an angle to the grain, pressure on the face of the doll causes the face to collapse in a flat plane and not to wrinkle. Looking at FIG. 1, if one were to attempt to pull the fabric in the direction of the grain line 38, or in a line perpendicular to the grain line 38 which would be the alternate grain line of the fabric, the fabric would not pull, stretch or give substantially because the stretching ability of the threads themselves would be the limiting factor on the ability of the fabric to stretch. On the other hand, if one were to pull on the fabric from rear edge 30 to front edge 32, the pull would be at an angle to the direction to the running of the threads of the fabric so that the fabric could expand or stretch because the grids could expand or stretch. The fabric could stretch in either one of two directions, by pulling on the fabric in the direction of front 32 or from top 26 in the direction of bottom 28. In other words, the grain line 38 is the line of strength and a line of stretch would have to be at an angle to the grain line of the fabric. Because face 14 is larger than back of head 64, once the head 106 of doll 10 is stuffed after darts 74 are placed in back of head 64, any pressure that is applied to face 14 will be directed to back of head 64 and cause the back of the head to flatten and allow the face to remain wrinkle free.

In the preferred embodiment, the computer portrait is made by using well-known technology such as the CASI Futura II Computer Portrait System sold by the supplier identified above. The portrait is then heat pressed onto the face of the doll using standard technology which is well known in the art.

Thus, although there have been described particular embodiments of the present invention of a new and useful doll having a photograph for a face, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A doll having the photograph of an individual imprinted on the face thereof wherein the head of the doll is constructed from fabric having a square grid grain including:

a. a face panel cut from the fabric;

b. a side of the head panel, having a front and a back, formed from one or more substantially rectangular pieces of the fabric having a longitudinal axis and sewn together and shaped in a substantially oval configuration, the one or more substantially rectangular pieces of fabric having the grain line of the fabric at an angle substantially askew to the longitudinal axis of the rectangle pieces;

c. an upper silhouette cut from the fabric and having a plurality of darts;

d. the face panel sewn to the front of the side of the head panel and the upper silhouette sewn to the back of the side of the head panel thereby creating a chamber into which material is stuffed to form the head of the doll;

e. material stuffed into said chamber so that the face panel of the head of the doll will be substantially flat and the upper silhouette will be shaped substantially spherical; and f. a photograph of an individual's face heat pressed onto the face panel of the head of the doll.

2. The device of claim 1 wherein the side of the head panel has a cut-out proximate to the point on said face panel where the chin would be located when the photograph in pressed thereon.

3. The device of claim 1 wherein said side of the head panel is substantially elongated and said has a grain line running at approximately a forty-five degree (45°) angle from said elongation.

4. The device of claim 1 wherein said face panel has a grain line running substantially vertical from a top to a bottom.

5. The device of claim 1 wherein said upper silhouette has a grain line running substantially vertically along said upper silhouette.

6. The device of claim 1 further comprising:

a. a lower silhouette; and b. a front body panel.

7. The device of claim 6 wherein said lower silhouette has a grain line running substantially vertically.

8. The device of claim 6 wherein said front body panel has a grain line running substantially vertically.

9. The device of claim 1 further including an arm having a wrist and a hand, said arm further having a grain line running from said wrist to said hand.

10. A doll made of fabric and stuffed with filler material, said doll having a head with a face on the front thereof and a back of the head on the rear thereof, said head including a substantially oval shaped side of the head panel giving the head a depth of substantially constant cross-section from the front to the rear thereof, the back of the head including a panel with darts therein to give the head a substantially spherical shape at the rear thereof when the head of the doll is stuffed with said filler material, said fabric having a square grid grain and the side of the head panel formed from elongated segments of the fabric having the grain line of the fabric at an angle of approximately forty-five degrees (45°) to the longitudinal axis of the elongated segments of the fabric and the front of the head being substantially flat and having the photograph of an individual's face heat pressed thereon.

11. A method of making a cloth doll using square grid grain fabric with the photograph of an individual's face heat pressed thereon, including the steps of:

a. cutting a face panel from the cloth;

b. cutting a side of the head panel from the cloth diagonally of the grain of the fabric, said side of the head panel being substantially rectangular in shape with elongated ends and having a front and a back;

c. cutting an upper silhouette from the cloth and forming a plurality of darts about the perimeter thereof;

d. shaping the side of the head panel into a substantially oval configuration;

e. sewing the face panel to the front of the side of the head panel and the upper silhouette to the back of the side of the head panel thereby creating a chamber into which material can be stuffed to form the head of the doll;

f. stuffing material into the said chamber to form the head of the doll;

g. compacting the material stuffed into said chamber so that the face panel of the head of the doll will be substantially flat and the upper silhouette will be shaped substantially spherical; and h. heat pressing a photograph of an individual's face onto the face panel of the head of the doll after the chamber forming the head of the doll has been stuffed with filler material.

* * * * *